US010364132B2

(12) United States Patent
Ruffin et al.

(10) Patent No.: US 10,364,132 B2
(45) Date of Patent: Jul. 30, 2019

(54) PIPE LIFTING AND ORIENTING APPARATUS AND METHOD

(71) Applicant: Matrix Service Company, Tulsa, OK (US)

(72) Inventors: James West Ruffin, Jenks, OK (US); David Lee Redman, Tulsa, OK (US); Michael Musick, South Mounds, OK (US)

(73) Assignee: Matrix Service Company, Tulsa, OK (US)

( * ) Notice: Subject to any disclaimer, the term of this patent is extended or adjusted under 35 U.S.C. 154(b) by 0 days.

(21) Appl. No.: 15/386,881

(22) Filed: Dec. 21, 2016

(65) Prior Publication Data

US 2018/0170718 A1 Jun. 21, 2018

(51) Int. Cl.
*B66C 23/16* (2006.01)

(52) U.S. Cl.
CPC ..... *B66C 23/166* (2013.01)

(58) Field of Classification Search
CPC ..... B66C 5/025; B66C 23/022; B66C 23/18
USPC ..... 414/10–12, 23; 254/29 R, 30
See application file for complete search history.

(56) References Cited

U.S. PATENT DOCUMENTS 2,867,338 A * 1/1959 Simmonds ..... B66C 23/36 198/411
3,314,553 A * 4/1967 Vircks ..... E04F 21/1822 248/167
3,948,482 A 4/1976 Brophy
3,991,978 A * 11/1976 Jones ..... B66C 23/00 248/219.2
4,251,176 A * 2/1981 Sizer ..... E21B 15/00 166/77.4
4,280,785 A * 7/1981 Albrecht ..... B66C 13/08 294/103.1
4,482,130 A * 11/1984 Paredes ..... B66F 15/00 254/8 R
4,715,760 A * 12/1987 Browning ..... B66F 3/24 254/134
4,838,439 A 6/1989 Baziuk
5,797,504 A * 8/1998 Mangum ..... B66C 23/20 212/202
5,918,861 A * 7/1999 Parker ..... B66C 23/48 212/202
6,390,450 B1 * 5/2002 Bressner ..... B66F 9/06 254/17

(Continued)

FOREIGN PATENT DOCUMENTS

EP 1528030 B1 2/2006

*Primary Examiner* — Lynn E Schwenning
(74) *Attorney, Agent, or Firm* — Dunlap Codding, P.C.

(57) ABSTRACT

A pipe lifting apparatus and method related thereto are provided, wherein the pipe has a base with outriggers, a vertically extending beam having a pulley at its upper end and a cable attached to a winch and extending over the pulley. The pulley and winch are oriented so that the cable extends naturally in line with a vertex between two of the outriggers such that, when a pipe in a vertical sleeve is attached to the distal end and is lifted by the cable, the pipe passes adjacent to the vertex. The apparatus is configured to raise pipes from a vertical pipe sleeve used in floating roofs of above-ground storage tanks. The apparatus can be used to raise and lower pipes and to move them around the upper surface of the floating roof of the tanks.

21 Claims, 9 Drawing Sheets

(56) References Cited

U.S. PATENT DOCUMENTS

| | | | | |
|---|---|---|---|---|
| 6,554,254 | B2 * | 4/2003 | Vetesnik | A62B 1/06 254/325 |
| 7,048,258 | B1 | 5/2006 | Dromgool et al. | |
| 7,213,715 | B2 | 5/2007 | Boily | |
| 7,448,598 | B1 * | 11/2008 | Elmlinger | B66D 1/28 254/338 |
| 7,527,244 | B2 * | 5/2009 | MacPherson | B66D 1/12 254/334 |
| 8,282,077 | B1 * | 10/2012 | Bonney | A01G 23/02 254/132 |
| 8,708,350 | B2 * | 4/2014 | Bottazzi | B62B 1/002 280/35 |
| 2008/0173244 | A1 | 7/2008 | Welker et al. | |
| 2008/0237415 | A1 | 10/2008 | Michalec | |
| 2009/0045015 | A1 | 2/2009 | Anstead et al. | |
| 2010/0301289 | A1 * | 12/2010 | Rivard | E04H 17/265 254/30 |

* cited by examiner

PIPE LIFTING AND ORIENTING APPARATUS AND METHOD

FIELD

The present disclosure relates generally to apparatuses and methods for raising and lowering pipes during installation of the pipes.

BACKGROUND

In many fields, it is necessary to orient pipe so as to position them substantially vertical for installation. Typically, such orienting requires the pipe to be raised and lowered. For example, pipe sleeves may be installed in the ground, a concrete slab, or similar horizontal base. Afterwards, the pipe needs to be positioned in the sleeve such that it extends vertically upward from the sleeve. The positioning of the pipe requires that the pipe be raised with one end of the pipe positioned over the sleeve and then lowered into the sleeve.

Such raising, lowering and orientation of the pipe results in numerous safety concerns. For example, injury can occur to the worker's hands due to hazards related to orienting and lowering the pipe. Additionally, manually raising the pipe can result in strained muscles, back injuries and/or other hazards.

SUMMARY

The above-described hazards are prevented by use of an apparatus and process according to embodiments of the current invention. Other advantages will be apparent from the discussion below. According to some embodiments, the pipe lifting and orienting apparatus comprises a base, a beam, a winch and a cable. A first outrigger and second outrigger extend from the base to form a vertex. A third outrigger extends from the base in opposition to the vertex so that the first outrigger, the second outrigger and the third outrigger form a Y-shape and support the base on a surface. The beam extends vertically from the base. The beam has a first end attached to the base and a second end terminating in a pulley. The winch is attached to the beam. The cable is operably attached to the winch and operably extends over the pulley. The cable has a distal end from the winch, and the distal end is configured to be attached to a pipe. The pulley and the winch are oriented so that the cable extends naturally in line with the vertex such that, when a pipe in a vertical sleeve is attached to the distal end and is lifted by the cable, the pipe passes adjacent to the vertex.

In some embodiments, the first outrigger, the second outrigger and the third outrigger are of equal length and extend straight and/or horizontally out from the base. Each outrigger can have a swivel wheel such that the apparatus can be moved on the surface in any direction. The swivel wheels can be lockable to prevent movement during the operational use of the apparatus.

The apparatus can further comprise a handle removably connected to the third outrigger and the beam. The handle is configured such that movement of the apparatus can be controlled using the handle. The apparatus can also comprise a stabilizing strap configured to wrap around the pipe and restrict lateral movement of the pipe when the pipe is lifted.

In some embodiments, the beam is made up of two or more interlocking pieces that removably connect together to form the beam. The interlocking pieces can comprise a first interlocking piece, one or more intermediate interlocking pieces and a terminal interlocking piece with each interlocking piece having an upper end and a lower end. The lower end of the first interlocking piece is removably connected to the base, the upper end of the first interlocking piece is removably connected to the lower end of one of the intermediate interlocking pieces, the lower end of the terminal interlocking piece is removably connected to an upper end of one of the intermediate interlocking pieces and the upper end of the terminal interlocking piece terminates in the pulley. The interlocking pieces can be removably connected using a hitch pin.

According to other embodiments, a method of lifting a pipe from a vertical pipe sleeve in the floating roof of a storage tank is provided. The method comprising the steps of:

(a) providing a lifting frame having:
- a base having a first outrigger and second outrigger extending from the base so as to form a vertex and a third outrigger extending from the base in opposition to the vertex so that the first outrigger, the second outrigger and the third outrigger form a Y-shape and support the base on a surface;
- a beam extending vertically from the base; the beam having a first end attached to the base and a second end terminating in a pulley;
- a winch attached to the beam;
- a cable operably attached to the winch and operably extending over the pulley, wherein the cable has a distal end from the winch and the distal end is configured to be attached to a pipe, wherein the pulley and the winch are oriented so that the cable extends naturally in line with the vertex such that, when a pipe in a vertical sleeve is attached to the distal end and is lifted by the cable, the pipe passes adjacent to the vertex;

(b) attaching the distal end of the cable to a first end of the pipe; and (c) actuating the winch to lift the pipe such that the pipe rises out of the vertical pipe sleeve and passes adjacent to the vertex.

In some of the embodiments, after step (b) and prior to step (c), the method further comprises the steps of:

(i) actuating the winch to make the cable tight; and (ii) wrapping a stabilizing strap around the cable such that when the winch is actuated to lift the pipe, the pipe moves into the stabilizing strap such that lateral movement of the pipe is restricted.

In some of the embodiments, after step (c), the method comprises:

(d) moving the lifting frame to a disposal location;

(e) removing the stabilizing strap from the pipe;

(f) actuating the winch to at least partially lower the pipe; and (g) detaching the cable from the pipe.

Additionally, the method can comprise the following steps after step (g):

(h) moving the lifting frame to a replacement location wherein a replacement pipe is located;

(i) attaching the distal end of the cable to the replacement pipe;

(j) wrapping the stabilizing strap around the cable;

(k) actuating the winch to raise the replacement pipe such that the replacement pipe moves into the stabilizing strap such that lateral movement of the pipe is restricted;

(l) moving the lifting frame such that the vertex is adjacent to the pipe sleeve;

(m) removing the stabilizing strap from the replacement pipe;

(n) actuating the winch to at least partially lower the replacement pipe into the vertical pipe sleeve; and (o) detaching the cable from the pipe.

In some of these embodiments, the step of providing a lifting frame comprises:

(i) providing the base and the first outrigger, the second outrigger and the third outrigger;

(ii) attaching the outrigger to the base such that the outriggers extend from the base so as to support the base on a surface;

(iii) providing a plurality of interlocking pieces having a first interlocking piece, one or more intermediate interlocking pieces and a terminal interlocking piece with the first interlocking piece and each intermediate interlocking piece each having an upper interlocking end and a lower interlocking end and the terminal interlocking piece having a lower interlocking end and an upper end terminating in the pulley;

(iv) connecting the lower interlocking end of the first interlocking piece to the base;

(v) connecting the plurality of interlocking pieces so as to form the beam; and (vi) connecting a handle to the third outrigger and to the first interlocking piece.

The method can also comprise moving the lifting frame such that the vertex is adjacent to the vertical pipe sleeve prior to step (b).

BRIEF DESCRIPTION OF THE DRAWINGS

FIG. 6B is a schematic perspective view of the lifting frame in use as shown in FIG. 6A.

DESCRIPTION OF INVENTION

Figure 1:
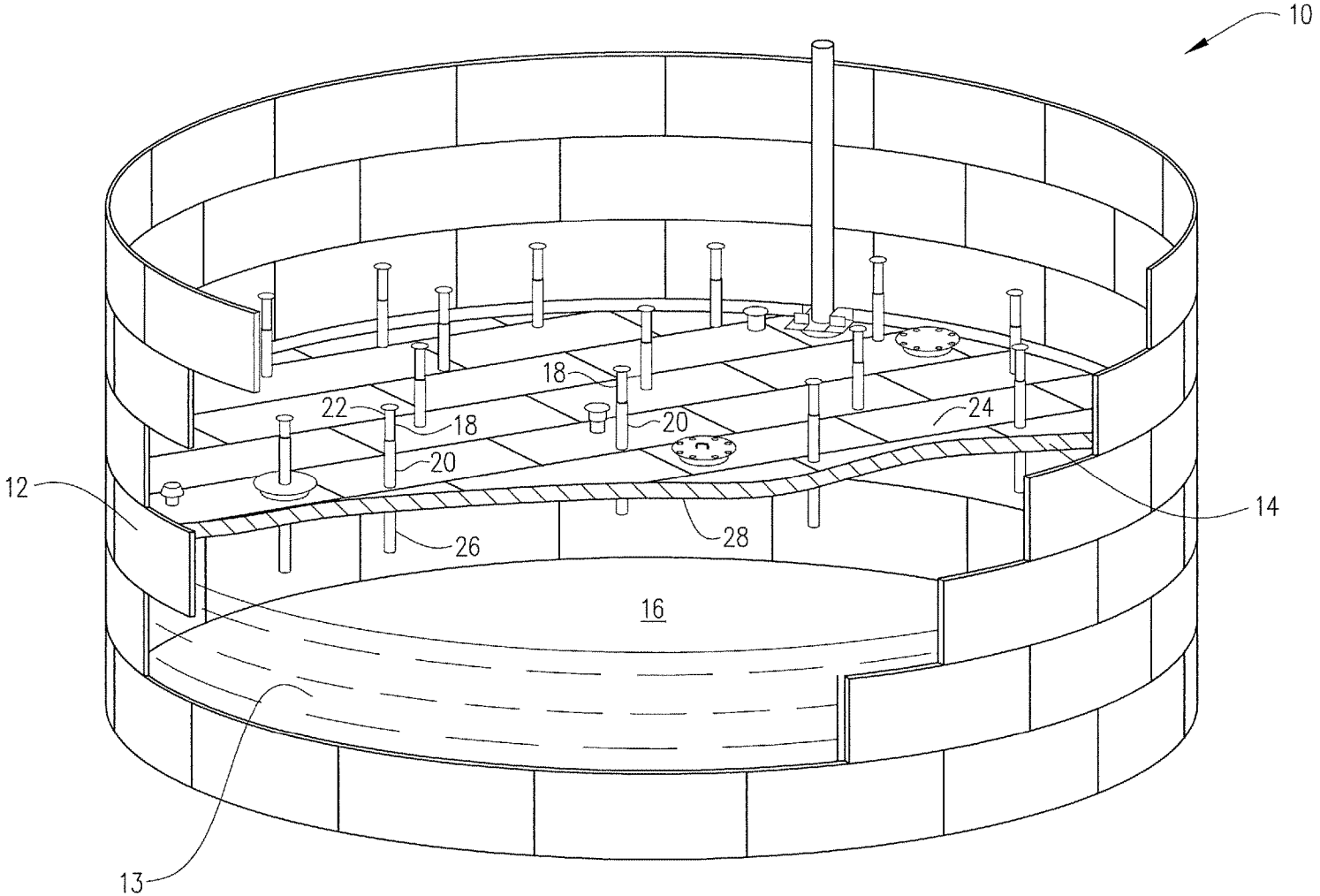
FIG. 1 is a schematic perspective view of an external floating roof tank with partial cut-away to show the support legs.

In the description that follows, like parts are marked throughout the specification and drawings with the same reference numerals, respectively. The drawings are not necessarily to scale and the proportions of certain parts have been exaggerated to better illustrate details and features of the invention. The terms "inwardly" and "outwardly" are directions toward and away from, respectively, the geometric axis of a referenced object. Where components of relatively well-known design are employed, their structure and operation will not be described in detail.

Pipes, including tubes, bars and beams, are often installed vertically for various applications. For example, the pipes can serve as support beams, guide beams, conduits for wiring or conduits for liquids.

One area of application requiring the vertical installation of pipes as support and/or guide beams is in floating roof tanks. A floating roof tank is an above-ground storage tank commonly used to store large quantities of petroleum products such as crude oil or condensate. While there are various designs of floating roof tanks, an external floating roof tank 10 is illustrated in FIG. 1. Tank 10 comprises a cylindrical shell 12 having a floor 13 and equipped with a roof 14 that floats on the surface of the stored liquid 16, such as crude oil or condensate. The roof 14 rises and falls with the liquid level in tank 10. As opposed to a fixed roof tank, a floating roof tank typically has no vapor space in the floating roof tank. In principle, this eliminates breathing losses and greatly reduces the evaporative loss of the stored liquid. There is a rim seal system between the tank shell and roof to reduce product evaporation in the rim space.

The roof 14 has support legs 18 (generally referred to under the term "pipes" herein) hanging down into the liquid. The legs or pipes 18 are received in vertical pipe sleeves 20 and extend through roof 14 so that a first portion 22 extends above the upper surface 24 of roof 14 and a second portion 26 extends below lower surface 28 of roof 14. Generally, each pipe 18 can be slidably received in its vertical pipe sleeve 20; however, a leg pin, which retains pipe 18 in vertical pipe sleeve 20, typically restrains movement in vertical pipe sleeve 20. Thus, pipe 18 can retract or move upward if the leg pin is removed, but still be retained in vertical pipe sleeve 20 when the lower end 30 of pipe 18 contacts the floor 13 of tank 10. At low liquid levels the roof eventually lands, resting on support legs (pipes) 18; thus, a vapor space can form between the liquid surface and the roof, similar to a fixed roof tank. The retractable support legs (pipes) 18 allow the roof to reach a lower height thus increasing the working volume of the tank in which a vapor space does not exist.

Figure 2:
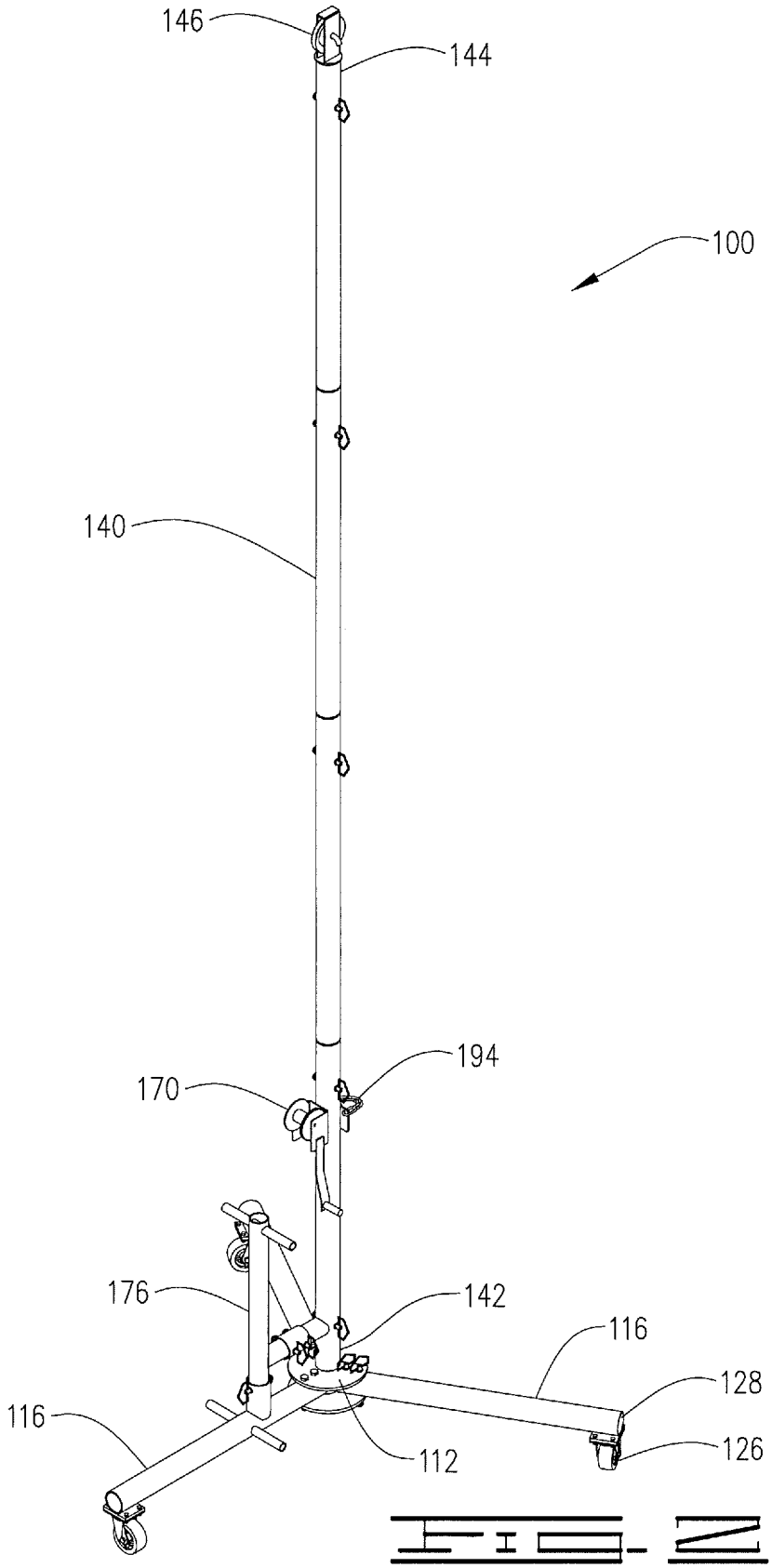
FIG. 2 is schematic perspective view of a pipe lifting and orienting apparatus or lifting frame in accordance with one embodiment.
Figure 3:
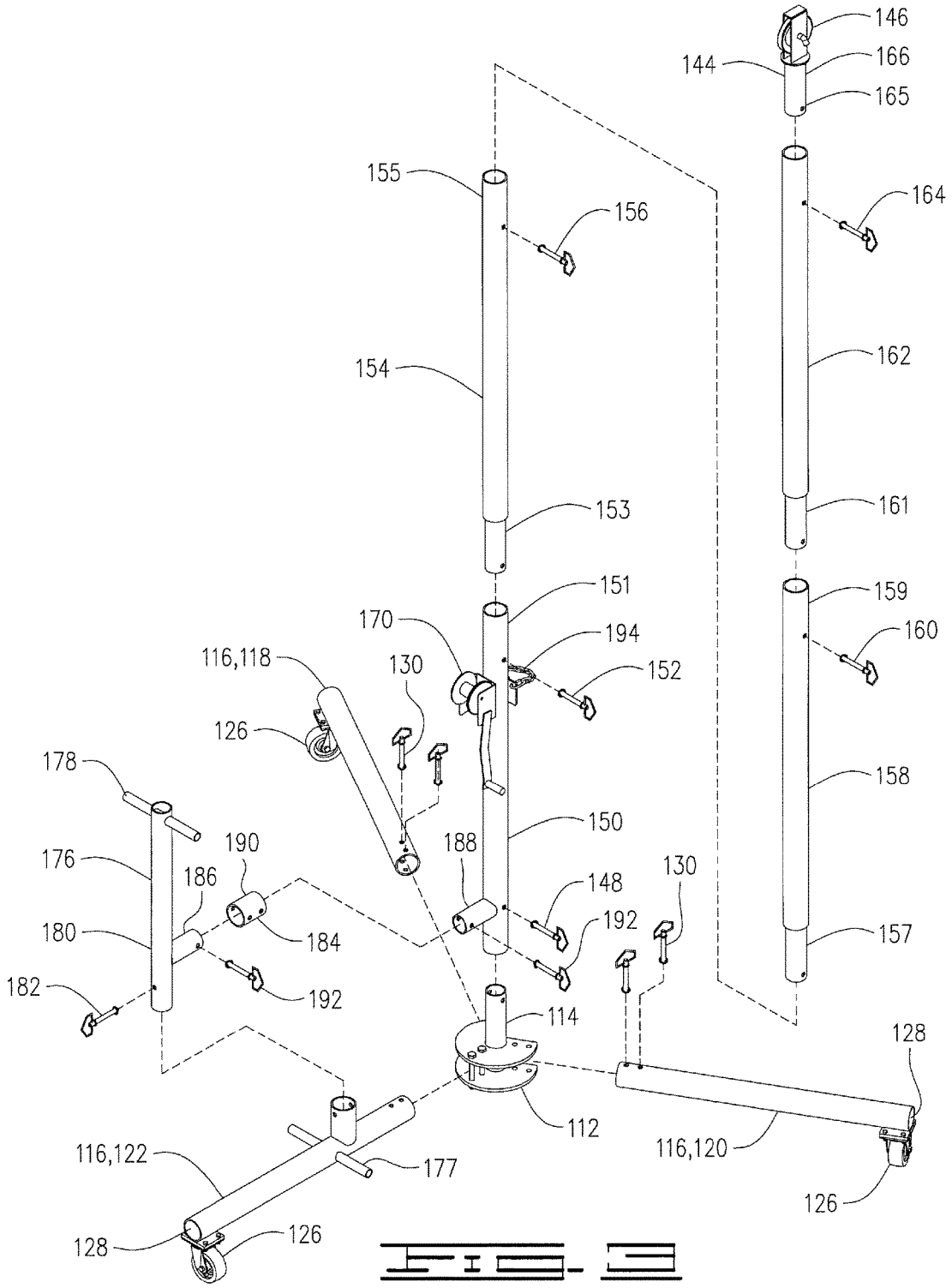
FIG. 3 is a schematic explosive view of the lifting frame of the embodiment of FIG. 2.
Figure 4:
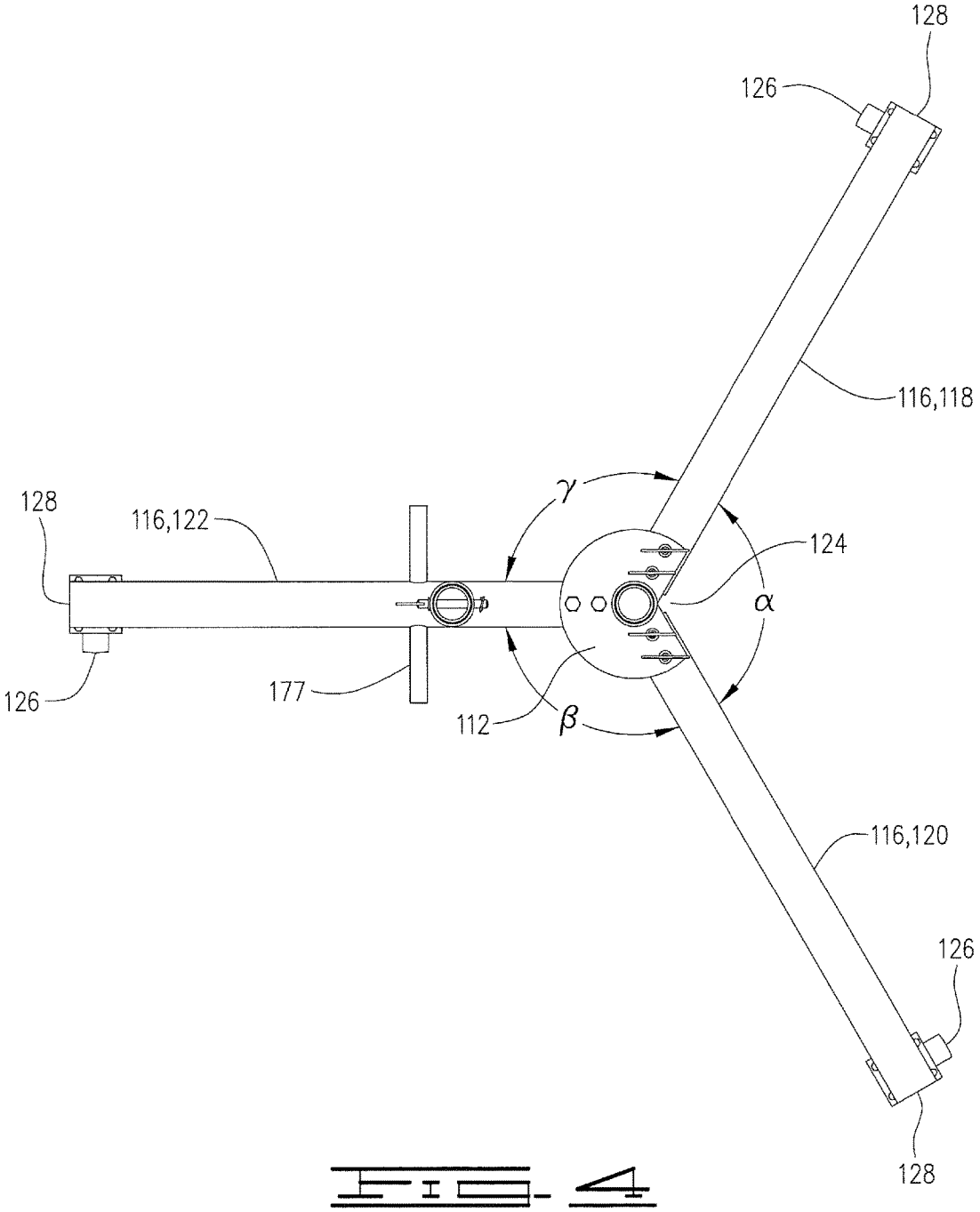
FIG. 4 is a schematic top view of the base of the lifting frame of the embodiment of FIG. 2 with outriggers attached.

In the above floating-roof tank application, as well as other applications, lifting and orienting of a pipe for placement can be carried out by the current lifting frame 100 illustrated in FIGS. 2-4. Lifting frame 100 is a pipe lifting and orienting apparatus. As can be seen from FIGS. 2-4, the current lifting frame 100 comprises a base 112 having three or more outriggers 116 extending from base 112 so as to support the base on a surface, such as roof 14 of floating roof tank 10 shown in FIG. 1. Although, lifting frame 100 can have more than three outriggers 116, three outriggers are currently preferred over 4 or more outriggers, because three outriggers provide greater stability on uneven surfaces and during movement of the lifting frame. Generally, outriggers 116 will extend out horizontally from the base, and typically, outriggers 116 will extend straight out from the base so as to not curve or be bent in an angle, As best seen from FIGS. 3 and 4, outriggers 116 generally comprise a first outrigger 118, second outrigger 120 and a third outrigger 122. First outrigger 118 and second outrigger 120 extend from base 112 so as to form a vertex 124. Third outrigger 122 extends from base 112 in opposition to vertex 124 so that the first outrigger, the second outrigger and the third outrigger form a Y-shape. Thus, there will be angle $\alpha$ between first outrigger 118 and second outrigger 120, angle $\beta$ between second outrigger 120 and third outrigger 122, and angle $\gamma$ between third outrigger 122 and first outrigger 118. In one embodiment, angles $\alpha$, $\beta$ and $\gamma$ are all about equal; thus, are all 120° or about 120°. "About" for the angles recited herein will mean plus or minus 5° or less. In other embodiments angle α will be from about 80° to about 140° and angles β and γ will be equal or about equal.

Typically, each outrigger 116 has a swivel wheel 126 such that lifting frame 100 can be moved on the surface. The wheels generally are located at or near distal end 128 of each outrigger 116 so as to provide greater stability for lifting frame 100. In some embodiments, the swivel wheels can be locking swivel wheels so that they can be locked so as to prevent movement.

Outriggers 116 can be removably attached to base 112 using hitch pins 130 or by using bolts or other suitable means. Also, in some embodiments, outriggers 116 can be integrally formed with base 112 so as to form a single unit, such as by welding outrigger 116 onto base 112.

As most easily seen from FIG. 2, beam 140 extends vertically from base 112. Beam 140 has a first end 142 attached to base 112 and a second end 144 terminating in a pulley 146. Beam 140 can be a solid pole or a hollow pipe. As can be seen from FIG. 3, first end 142 can be removably connected to base 112 by fitting it over a vertically extending neck 114 of base 112 and securing it with a hitch pin 148. Optionally, first end 142 can be integrally formed with base 112 or welded thereto. However, transportation of lifting frame 100 from one worksite to another is facilitated by beam 140 being removably connected to base 112.

In some embodiments, beam 140 is made up of two or more interlocking pieces that removably connect together to form beam 140. As shown in FIG. 3, beam 140 comprises a first interlocking piece 150, one or more intermediate interlocking pieces (shown as first intermediate interlocking piece 154, second intermediate interlocking piece 158, and third intermediate interlocking piece 162), and a terminal interlocking piece 166. First interlocking piece 150 has a lower end that is first end 142 of beam 140, thus is removably connected to base 112. First interlocking piece 150 has an upper end 151, which is removably connected to lower end 153 of first intermediate interlocking piece 154. As shown, upper end 151 is a sleeve end and lower end 153 is a neck end so that upper end 151 fits over lower end 153 in a snug but detachable manner and can be locked in place by a hitch pin 152. The intermediate interlocking pieces are similarly attached to each other; thus, upper end 155 of first intermediate interlocking piece 154 is a sleeve end that fits over lower end 157 (a neck end) of second interlocking piece 158 and is locked in place by hitch pin 156. Similarly, upper end 159 of second intermediate interlocking piece 158 is a sleeve end that fits over lower end 161 (a neck end) of third interlocking piece 161 and is locked in place by hitch pin 160.

The upper most intermediate interlocking piece is connected at its upper end to terminal interlocking piece 166. Thus, as shown, third intermediate interlocking piece 162 is removably connected at upper end 163, a sleeve end, to lower end 165, a neck end, of terminal interlocking piece 166 and locked in place by hitch pin 164. The upper end of terminal interlocking piece 166 is second end 144 of beam 140; thus, it terminates in pulley 146.

A winch 170 is attached to beam 140. Winch 170 can be a simple spool and hand crank winch or can be a motorized winch. Typically, winch 170 can be attached on the lower half of beam 140 and often on first interlocking piece 150. A cable 172 (FIG. 5A) can be operably attached to winch 170 so as to be let out (wound out) by winch 170 when the spool of winch 170 winds in a first direction and let in (wound in) when the spool of winch 170 winds in a second direction. Cable 172 operably extends over pulley 146 and has a distal end 174 (FIG. 5A), which is distal from winch 170. Distal end 174 is configured to attach to a pipe 18, shown in FIG. 5A. Distal end 174 can attach to pipe 18 by any suitable means, for example, it can attach by a hook or a threaded collared yoke, which threadedly engages on a first pipe end 17 of pipe 18 (see FIG. 6A).

Pulley 146 and winch 170 are oriented so that cable 172 extends naturally in line with vertex 124 such that, when pipe 18 is in vertical pipe sleeve 20, it is attached to distal end 174 and is lifted by cable 172, pipe 18 passes adjacent to vertex 124. In other words, "extends naturally in line with the vertex" means when distal end 174 is lowered to be at even level with vertex 124, gravity will place distal end 174 adjacent to the vertex. In most embodiments, cable 172 will extend along and be adjoining or contacting beam 140 when cable 172 "extends naturally in line with the vertex. Thus, in most embodiments, distal end 174 adjoins vertex 124 when it is at even level with vertex 124; however, in some embodiments, distal end 174 is near but not adjoining vertex 124, typically, within 6 inches of vertex 124 and more typically within 4 inches, 3 inches, 2 inches or 1 inch of vertex 124. Thus, a pipe attached to distal end 174 will be similarly adjacent to vertex 124 when it is suspended by cable 172.

In many embodiments, lifting frame 100 has a handle 176 and pedal bar 177 by which a user can control the movement of lifting frame 100 and hold it stable during operation. Pedal bar 177 typically is connected to or integrally formed with third outrigger 122. Pedal bar 177 provides a place for an operator's foot to apply leverage in moving and orienting a pipe being carried by lifting frame 100.

Handle 176 can include handle bars 178 connected to a base bar 180. Typically, base bar 180 is substantially vertical and can be removably connected to third outrigger 122. The removable connection can be a sleeve-and-neck connection as described for the interlocking pieces of beam 140 above. Base bar 180 can be held in place by hitch pin 182. Additionally, base bar 180 can have a pivotal connection (not shown) to third outrigger 122 to facilitate connection of brace bar 184 to beam 140.

Additionally, handle 176 can have a brace bar 184, which removably connects handle 176 to beam 140. As shown, brace bar 184 comprises a first neckpiece 186, second neckpiece 188 and connection sleeve 190. First neckpiece 186 is connected to base bar 180 and, typically, is integrally formed therewith. Second neckpiece 188 is connected to beam 140, generally to first interlocking piece 150, and, typically, is integrally formed therewith. To connect handle 176 with beam 140, first neckpiece 186 and second neckpiece 188 are slid into connection sleeve 190 and hitch pins 192 are used to lock the pieces together. To facilitate the connection, one or both of first neckpiece 186 and second neckpiece 188 can be pivotally attached (not shown) to base bar 180 or beam 140, respectfully.

Additionally, beam 140 can comprise a stabilizing strap 194. Stabilizing strap 194 can be a cable, cord, rope, chain or similar. Stabilizing strap 194 is connected to beam 140 and configured to be able to wrap around a pipe being lifted so as to restrict lateral movement of the pipe relative to lifting frame 100 during raising and lowering of the pipe, and during movement of lifting frame 100 upon a surface. Typically, stabilizing strap 194 is attached to beam 140 at first interlocking piece 150.

Figure 5A:
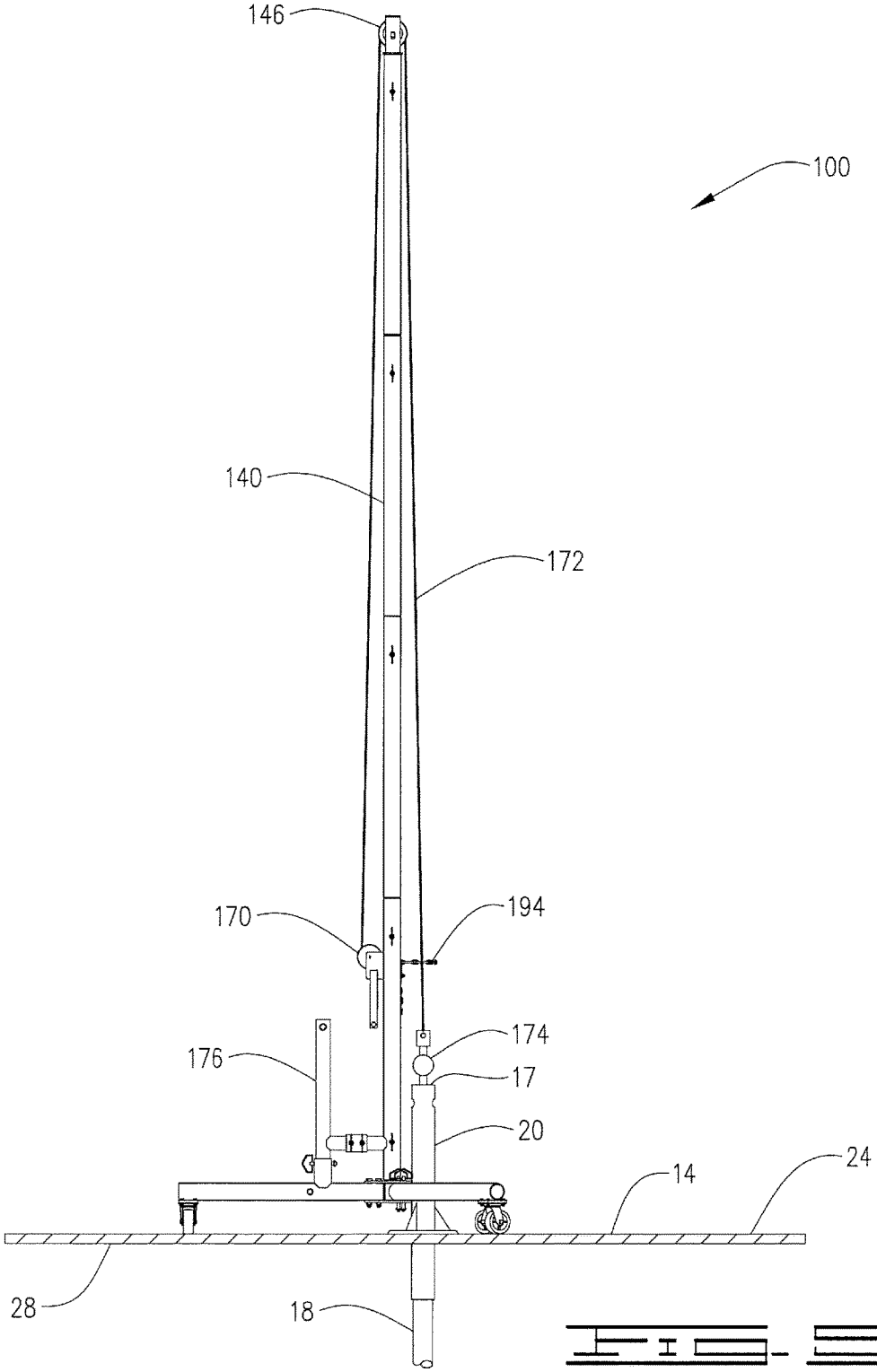
FIG. 5A is a schematic side view of the lifting frame of the embodiment of FIG. 2 in use, wherein the cable of the lifting frame is attached to a pipe in a vertical pipe sleeve.
Figure 5B:
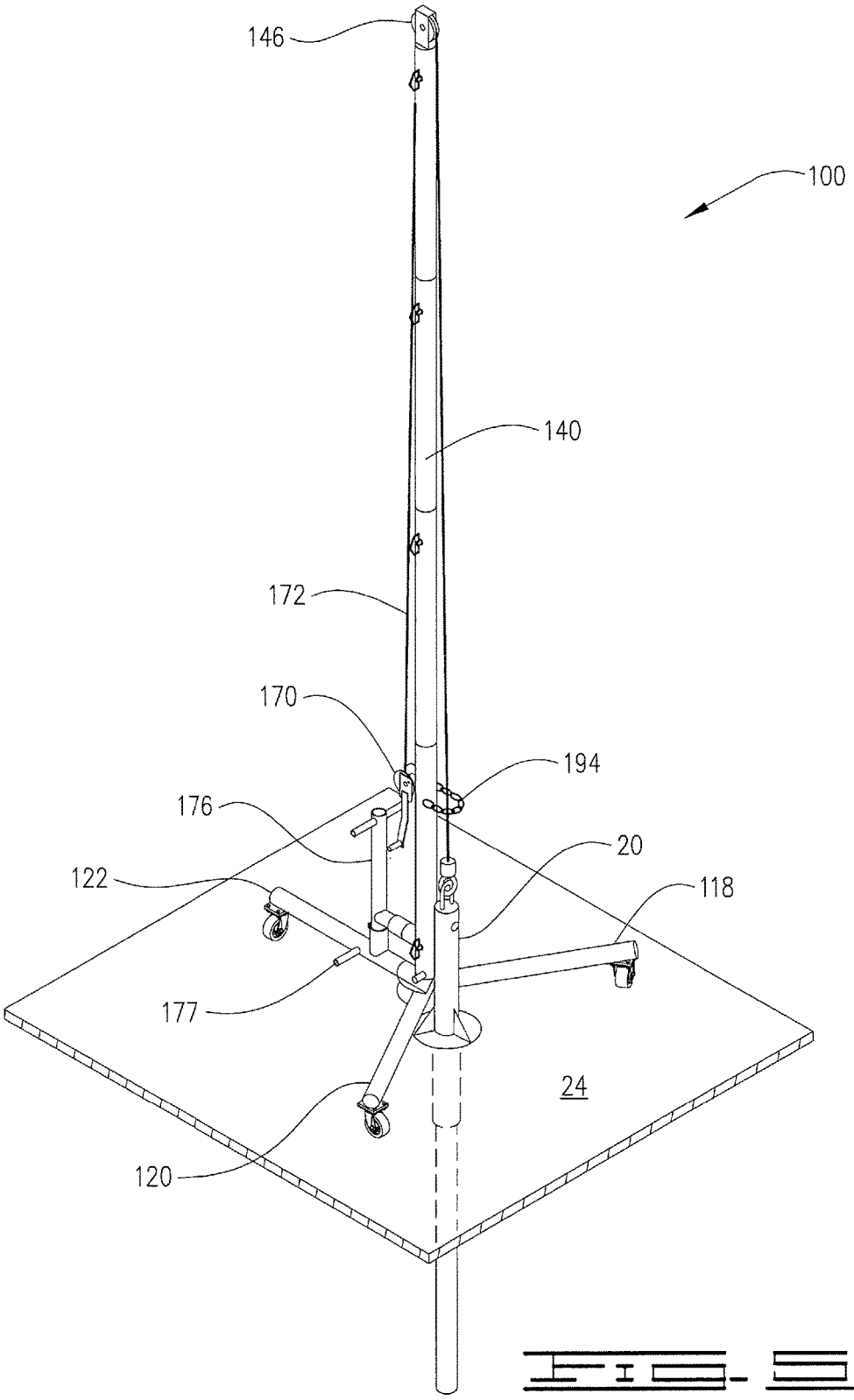
FIG. 5B is a schematic perspective view of the lifting frame in use as shown in FIG. 5A.

The operation of lifting frame 100 will now be described with reference to FIGS. 5A, 5B, 6A and 6B. In FIG. 5A and 5B, lifting frame 100 is first brought to a worksite, typically upper surface 24 of roof 14 of a floating roof tank where support legs (pipe) need to be replaced. Lifting frame 100 can be brought to the worksite as a single unit and can even be a single unit with pieces that are integrally formed, welded together or have connections that are not readily separated. However, in most embodiments, lifting frame 100 is a unit that is readily separable into disassembled pieces and is brought to the worksite in such a disassembled state for ease of transportation. Accordingly, lifting frame 100 will generally be assembled at the worksite.

With reference to FIG. 3, lifting frame 100 is assembled by connecting outriggers 116 to base 112 by inserting outriggers 116 into base 112 such that outriggers 116 extend from base 112 and are spaced evenly around the circumference or parameter of base 112. Outriggers 116 are locked into position using hitch pins 130, bolts or other suitable means. Base 112 can now be supported on upper surface 24 of roof 14 by outriggers 116 with swivel wheels 126 resting on the surface 24.

Next, the interlocking pieces 150, 154, 158, 162 and 166 of beam 140 are assembled. First end 142 of first interlocking piece 150 is connected to base 112 by inserting neck 114 of base 112 into first or lower end 142. Typically, this connection is locked in place using hitch pin 148, bolts or other suitable means. Following this, the intermediate interlocking pieces 154, 158, 162 and terminal interlocking piece 166 are connected to first interlocking piece 150 by connecting the upper ends 151, 155 and 159 to lower interlocking ends 153, 157 and 161 such that beam 140 is formed from interlocking pieces 150, 154, 158, 162 and 166. The connected beam 140 has upper end 151 of first interlocking piece 150 connected to lower end 153 of first intermediate interlocking piece 154, which is in turn connected to second intermediate interlocking piece 158 in a similar manner, which itself is connected to intermediate interlocking piece 162 in a similar manner. Lower end 165 of terminal interlocking piece 166 is connected to upper end 163 of third intermediate interlocking piece 162. The interlocking pieces can be locked into position by using hitch pins 152, 156, 160 and 164 or by using bolts or other similar means. While illustrated with three intermediate interlocking pieces, it will be understood that any number of intermediate interlocking pieces can be used in order to give beam 140 sufficient height to lift pipe 18 out of sleeve 20 and to carry pipe 18 without it dragging on upper surface 24.

Generally, at any time after first interlocking piece 150 is connected to base 112, handle 176 can be connected to lifting frame 100 by connecting base bar 180 to third outrigger 122 and by connecting first neckpiece 186 and second neckpiece 188 using connection sleeve 190. The components can be locked into place using hitch pins 182 and 192, or using bolts or other similar means.

Next, cable 172 can be operably connected to winch 170, if not already connected, and operably extended over pulley 146. If not already in position, the now assembled lifting frame 100 can be moved by rolling on surface 24 such that vertex 124 is adjacent to a vertical pipe sleeve 20 containing a pipe 18, which needs to be replaced, as shown in FIGS. 5A and 5B. Distal end 174 of cable 172 is attached to a pipe 18 at first pipe end 17. Winch 170 is actuated to place tension on cable 172 thereby making cable 172 tight. Stabilizing strap 194 is wrapped around cable 172. Subsequently, winch 170 is actuated to continue raising pipe 18 out of vertical pipe sleeve 20.

Figure 6A:
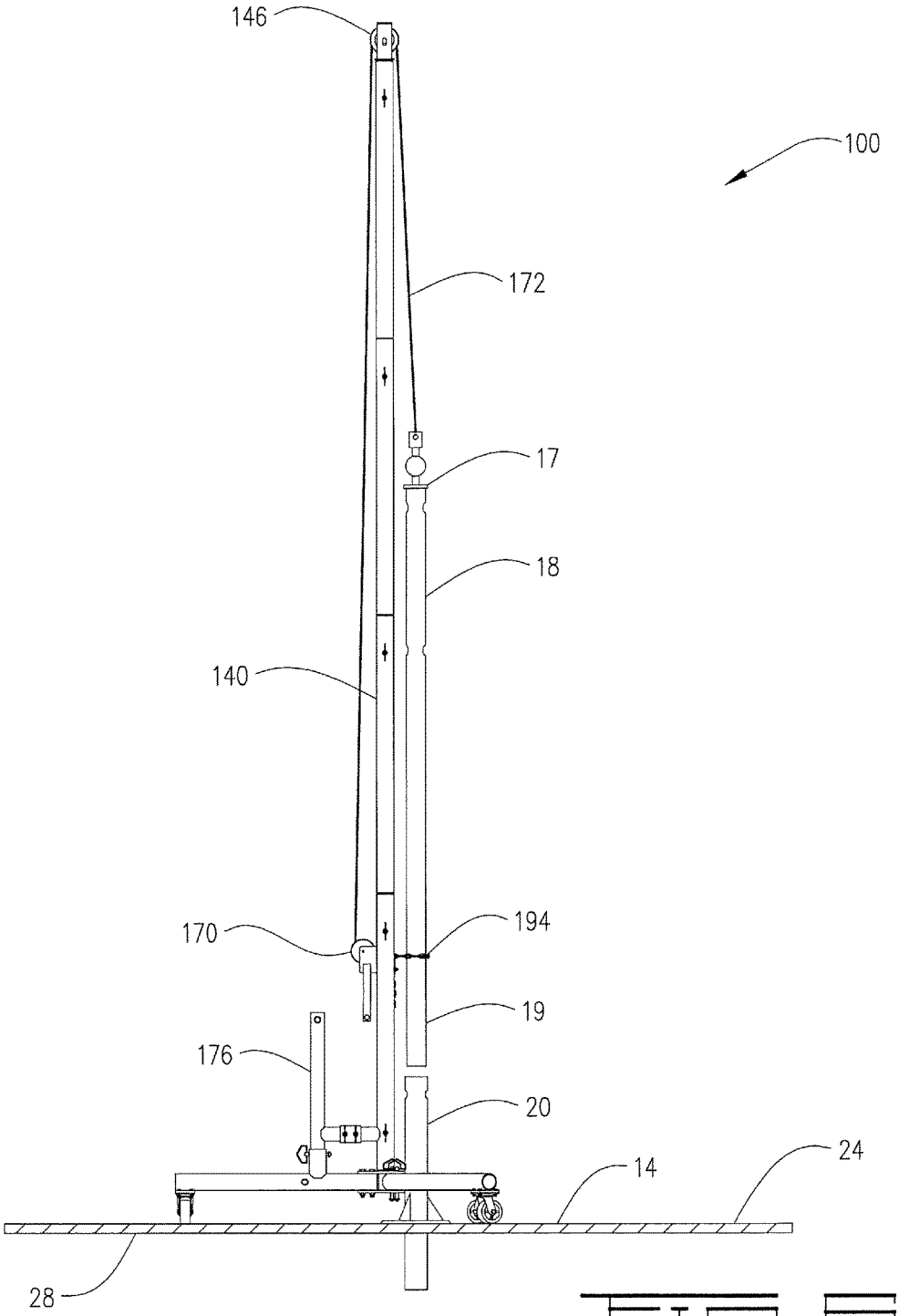
FIG. 6A is a schematic side view of the lifting frame in use, wherein the pipe has been lifted such that the lower end of the pipe has cleared the vertical pipe sleeve.
Figure 5B:
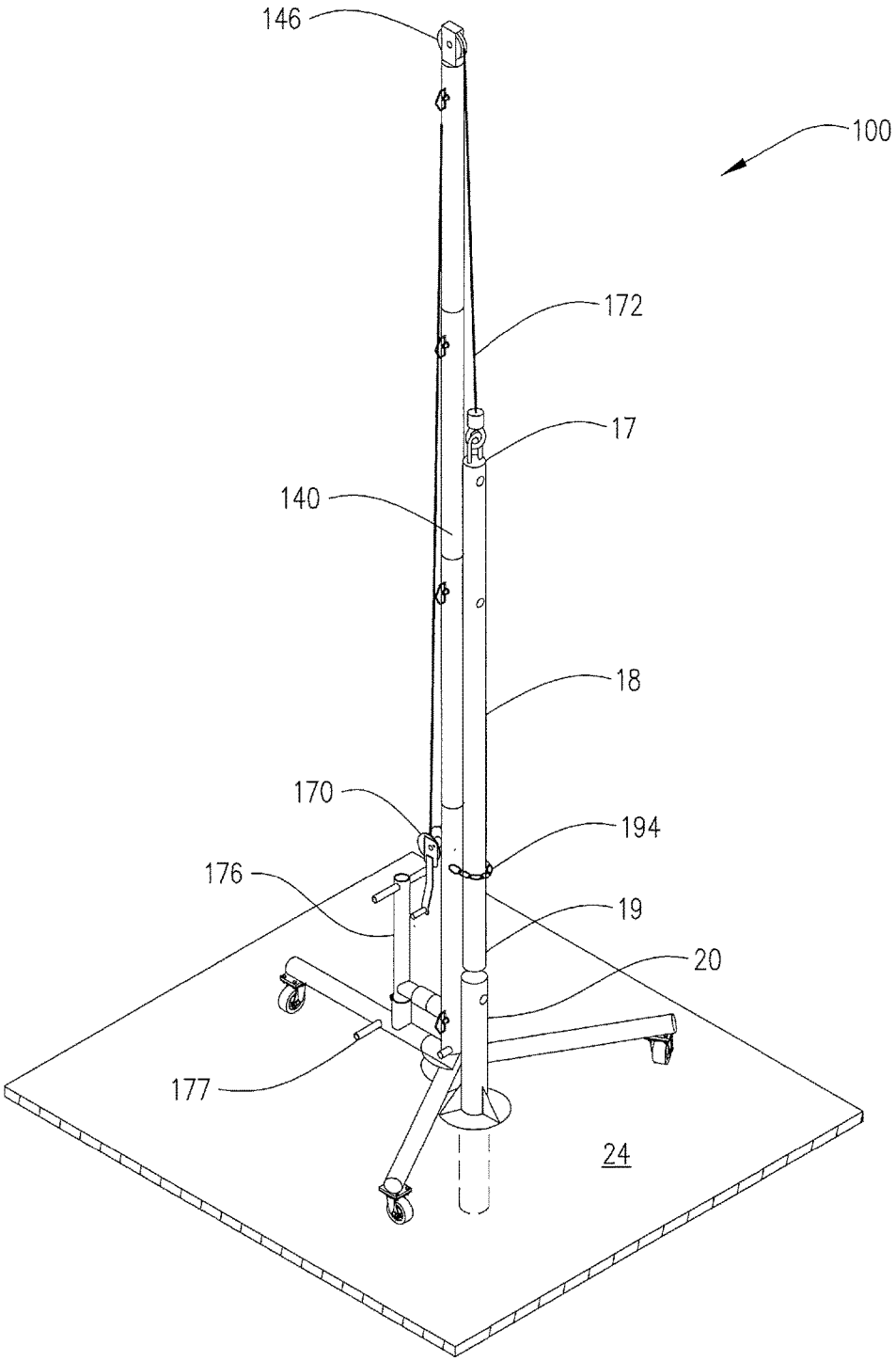
Figure 7:
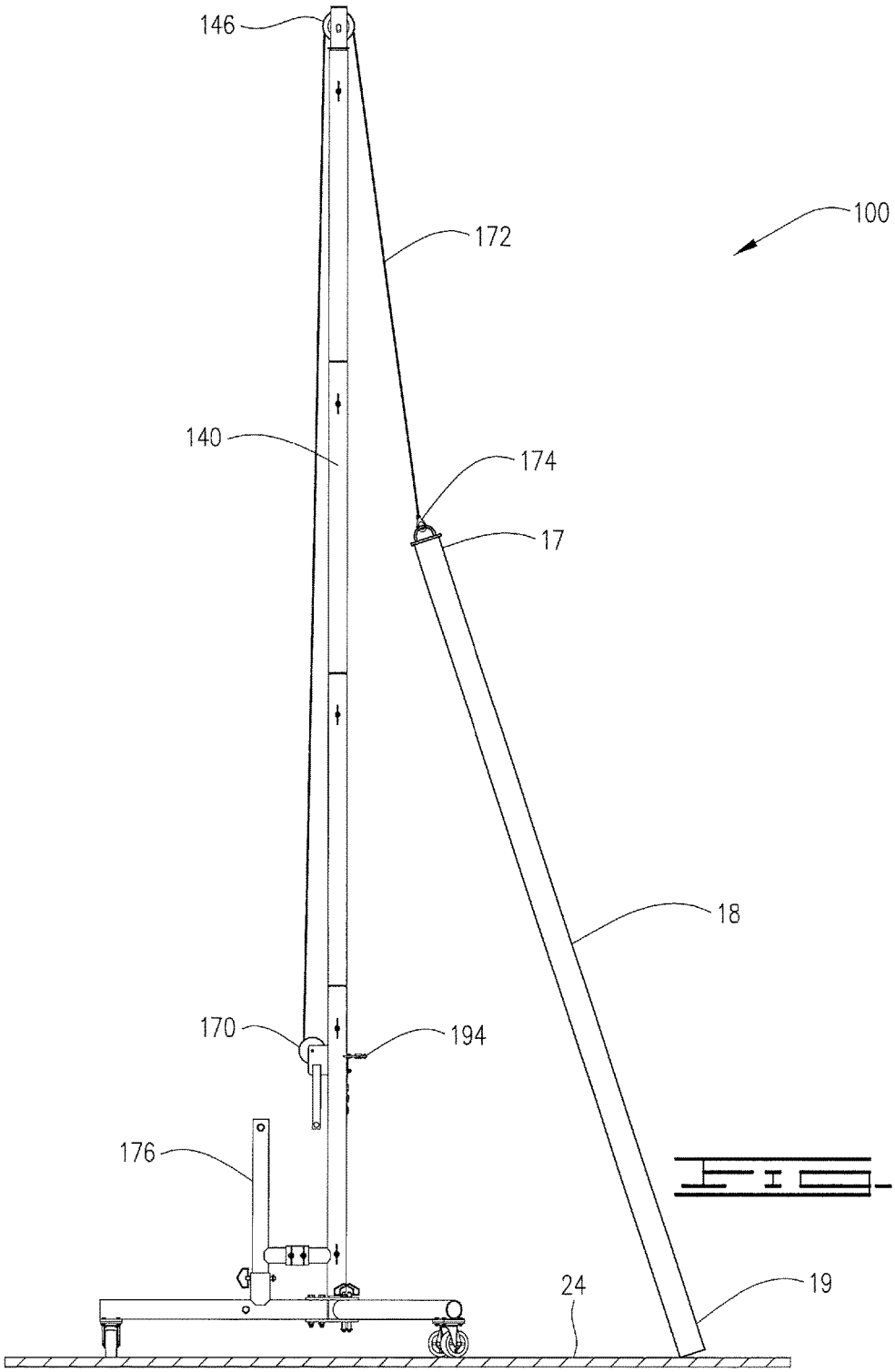
FIG. 7 is a schematic side view of the lifting frame of the embodiment of FIG. 2, lowering a pipe to a surface.

Turning now to FIGS. 6A and 6B, as pipe 18 is raised, pipe 18 moves into stabilizing strap 194, which becomes wrapped around pipe 18, thus restricting lateral movement of pipe 18 relative to lifting frame 100. With pipe 18 raised clear of vertical pipe sleeve 20 and upper surface 24, lifting frame 100 can be moved to a disposal location by utilizing handle 176 and pedal bar 177. At the disposal location, stabilizing strap 194 is removed from pipe 18, as shown in FIG. 7. Winch 170 is actuated to at least partially lower pipe 18 to the surface at the disposal location. After pipe 18 is lowered, cable 172 is detached from pipe 18.

Next lifting frame 100 is moved to a replacement location where replacement pipe is located. Distal end 174 of cable 172 is attached to a replacement pipe, stabilizing strap 194 is wrapped around cable 172 and winch 170 is activated to raise the replacement pipe. In some uses, the replacement pipe can be at least partially lifted or completely lifted prior to wrapping stabilizing strap 194 around the replacement pipe. Lifting frame 100 and the replacement pipe can now be moved to vertical pipe sleeve 20 so that vertex 124 is adjacent to vertical pipe sleeve 20.

As necessary, winch 170 can be actuated to raise the replacement pipe to a sufficient height such that second pipe end 19 is higher than vertical pipe sleeve 20. Stabilizing strap 194 can be removed and the replacement pipe oriented so that second pipe end 19 is positioned over vertical pipe sleeve 20. Next, winch 170 is actuated to lower the replacement pipe so as to introduce second pipe end 19 into vertical pipe sleeve 20. After the replacement pipe is in place in vertical pipe sleeve 20, cable 172 can be detached from the replacement pipe.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

That which is claimed is:

1. A pipe lifting and orienting apparatus comprising:

a base having a V-shaped notch with a first side and a second side cooperating to define a vertex and a vertical passage, the vertex defining an inner boundary of the vertical passage;

a first outrigger extending from the base adjacent to the first side;

a second outrigger extending from the base adjacent to the second side;

a third outrigger extending from the base in opposition to the vertex so that the first outrigger, the second outrigger and the third outrigger form a Y-shape and support the base on a surface;

a straight beam extending vertically from the base between the vertex and the third outrigger, the beam having a first end attached to the base and a second end terminating in a pulley;

a winch supported by the base and spaced a distance from the base; and a cable operably attached to the winch and operably extending over the pulley, wherein the cable has a distal end from the winch, and the distal end is configured to be attached to a pipe, wherein the pulley and the winch are oriented so that gravity will place the cable in the vertical passage adjacent to the vertex when the cable is lowered to be at an even level with the vertex such that, when the pipe is in a vertical sleeve, attached to the distal end, and lifted by the cable, the pipe passes through the vertical passage adjacent to the vertex.

2. The apparatus of claim 1, wherein the inner boundary of the vertical passage is substantially coextensive with one side of the straight beam.

3. The apparatus of claim 1, wherein at the vertex the first outrigger and the second outrigger meet at an angle $\alpha$ and the angle $\alpha$ is from about 80° to about 140°.

4. The apparatus of claim 3, wherein the angle $\alpha$ is about 120°.

5. The apparatus of claim 1, wherein each outrigger has a swivel wheel such that the apparatus can be moved on the surface.

6. The apparatus of claim 5, further comprising a handle removably connected to the third outrigger and the beam, wherein the handle is configured such that movement of the apparatus can be controlled using the handle.

7. The apparatus of claim 1, further comprising a stabilizing strap configured to wrap around the pipe and restrict lateral movement of the pipe when the pipe is lifted.

8. The apparatus of claim 1, wherein the beam is made up of two or more interlocking pieces that removably connect together to form the beam.

9. The apparatus of claim 8, wherein the interlocking pieces comprise a first interlocking piece, one or more intermediate interlocking pieces and a terminal interlocking piece with each interlocking piece having an upper end and a lower end, and wherein the lower end of the first interlocking piece is removably connected to the base, the upper end of the first interlocking piece is removably connected the lower end of one of the intermediate interlocking pieces, the lower end of the terminal interlocking piece is removably connected to an upper end of one of the intermediate interlocking pieces and the upper end of the terminal interlocking piece terminates in the pulley.

10. The apparatus of claim 9, wherein the interlocking pieces are removably connected using a hitch pin.

11. The apparatus of claim 10, wherein the first outrigger, the second outrigger and the third outrigger are of equal length and extend straight out from the base, and at the vertex the first outrigger and the second outrigger meet at an angle $\alpha$ and the angle $\alpha$ is about 120°, and wherein the apparatus further comprises:

a swivel wheel connected to each outrigger such that the apparatus can be moved on the surface, a handle removably connected to one of the outriggers and the first interlocking piece, wherein the handle is configured such that movement of the apparatus can be controlled using the handle; and a stabilizing strap configured to wrap around the pipe and restrict lateral movement of the pipe when the pipe is lifted.

12. A method of lifting a pipe from a vertical pipe sleeve in a floating roof of a storage tank, the floating roof having an upper surface and a lower surface with the vertical pipe sleeve extending through the upper surface and the lower surface of the floating roof, the method comprising the steps of:

(a) transporting a lifting frame onto the floating roof in a disassembled condition;

(a1) assembling a first outrigger, second outrigger, third outrigger, and straight beam to a base of the lifting frame on the floating roof to form an assembled lifting frame having:

the first outrigger extending from the base;

the second outrigger extending from the base and cooperating with the base and the first outrigger to form a vertex;

the third outrigger extending from the base in opposition to the vertex so that the first outrigger, the second outrigger and the third outrigger form a Y-shape and support the base on the upper surface of the floating roof;

the straight beam extending vertically from the base, the beam having a first end attached to the base and a second end terminating in a pulley;

a winch supported by the base and spaced a distance from the base; and a cable operably attached to the winch and operably extending over the pulley, wherein the cable has a distal end from the winch and the distal end is configured to be attached to a pipe, wherein the pulley and the winch are oriented so that gravity will place the cable adjacent to the vertex when the cable is lowered to be at an even level with the vertex such that, when the pipe is in a vertical sleeve, the pipe is attached to the distal end and the pipe is lifted by the cable, the pipe passes adjacent to the vertex;

(a2) moving the assembled lifting frame adjacent one of the vertical pipe sleeves so the vertex is positioned adjacent the vertical pipe sleeve;

(b) attaching the distal end of the cable to a first end of the pipe within the vertical pipe sleeve; and (c) actuating the winch to lift the pipe such that the pipe rises out of the vertical pipe sleeve and passes adjacent to the vertex.

13. The method of claim 12, wherein after step (b) and prior to step (c), the method further comprises the steps of:

(i) actuating the winch to make the cable tight; and (ii) wrapping a stabilizing strap around the cable such that when the winch is actuated to lift the pipe, the pipe moves into the stabilizing strap such that lateral movement of the pipe is restricted.

14. The method of claim 13, further comprising after step (c):

(d) moving the lifting frame to a disposal location;

(e) removing the stabilizing strap from the pipe;

(f) actuating the winch to at least partially lower the pipe; and (g) detaching the cable from the pipe.

15. The method of claim 14, further comprising after step (g):

(h) moving the lifting frame to a replacement location wherein a replacement pipe is located;

(i) attaching the distal end of the cable to the replacement pipe;

(j) wrapping the stabilizing strap around the cable;

(k) actuating the winch to raise the replacement pipe such that the replacement pipe moves into the stabilizing strap such that lateral movement of the pipe is restricted;

(l) moving the lifting frame such that the vertex is adjacent to the pipe sleeve;

(m) removing the stabilizing strap from the replacement pipe;

(n) actuating the winch to at least partially lower the replacement pipe into the vertical pipe sleeve; and (o) detaching the cable from the pipe.

16. The method of claim 12, wherein the step of assembling the lifting frame on the floating roof comprises:

(i) providing the base and the first outrigger, the second outrigger and the third outrigger;

(ii) attaching the outrigger to the base such that the outriggers extend from the base so as to support the base on the upper surface;

(iii) providing the straight beam, wherein the straight beam is made up of a plurality of interlocking pieces having a first interlocking piece, one or more intermediate interlocking pieces and a terminal interlocking piece with the first interlocking piece and each intermediate interlocking piece each having an upper interlocking end and a lower interlocking end and the terminal interlocking piece having a lower interlocking end and an upper end terminating in the pulley;

(iv) connecting the lower interlocking end of the first interlocking piece to the base;

(v) connecting the plurality of interlocking pieces so as to form the beam; and (vi) connecting a handle to the third outrigger and to the first interlocking piece.

17. The method of claim 16, further comprising moving the lifting frame such that the vertex is adjacent to the vertical pipe sleeve prior to step (b).

18. The pipe lifting and orienting apparatus of claim 1, wherein the beam is made up of two or more interlocking pieces that removably connect together to form the beam, and wherein the base, first outrigger, second outrigger and third outrigger are removably connected together.

19. A lifting and orienting apparatus in combination with a storage tank having a floating roof with an upper surface, a lower surface, a plurality of vertical sleeves extending through the upper surface and the lower surface of the floating roof, and a plurality of support legs extending through the vertical sleeves support the floating roof above a bottom of the storage tank at low liquid levels, the apparatus comprising:

a base;

a first outrigger extending from the base adjacent to the first side;

a second outrigger extending from the base adjacent to the second side and cooperating with the base and the first outrigger to form a vertex;

a third outrigger extending from the base in opposition to the vertex so the first outrigger, the second outrigger, and the third outrigger form a Y-shape supporting the base on the floating roof with the vertex positioned adjacent one of the vertical sleeves;

a straight beam extending vertically from the base between the vertex and the third outrigger, the beam having a first end attached to the base and a second end terminating in a pulley;

a winch supported by the base and spaced a distance from the base; and a cable operably attached to the winch and operably extending over the pulley, the cable having a distal end from the winch, the distal end configured to be attached to an adjacent one of the support legs, the pulley and the winch oriented so gravity will place the cable aligned with the vertex when the cable is lowered and connected to the adjacent support leg so the support leg is lifted from the vertical sleeve by the cable.

20. The combination of claim 19, wherein the beam is made up of two or more interlocking pieces that removably connect together to form the beam.

21. The combination of claim 20, wherein the interlocking pieces comprise a first interlocking piece, one or more intermediate interlocking pieces and a terminal interlocking piece with each interlocking piece having an upper end and a lower end, and wherein the lower end of the first interlocking piece is removably connected to the base, the upper end of the first interlocking piece is removably connected the lower end of one of the intermediate interlocking pieces, the lower end of the terminal interlocking piece is removably connected to an upper end of one of the intermediate interlocking pieces and the upper end of the terminal interlocking piece terminates in the pulley.

* * * * *